US010675197B2

(12) United States Patent
Eriksen et al.

(10) Patent No.: US 10,675,197 B2
(45) Date of Patent: Jun. 9, 2020

(54) METHOD AND EQUIPMENT FOR RAISING A LYING PERSON

(71) Applicant: Liftup A/S, Støvring (DK)

(72) Inventors: Flemming Eriksen, Støvring (DK); Anders Lykkegaard Møller, Sønderborg (DK)

(73) Assignee: Liftup A/S, Støvring (DK)

( * ) Notice: Subject to any disclaimer, the term of this patent is extended or adjusted under 35 U.S.C. 154(b) by 0 days.

(21) Appl. No.: 15/553,751

(22) PCT Filed: Feb. 27, 2015

(86) PCT No.: PCT/DK2015/050041

§ 371 (c)(1),
(2) Date: Aug. 25, 2017

(87) PCT Pub. No.: WO2016/134718

PCT Pub. Date: Sep. 1, 2016

(65) Prior Publication Data

US 2018/0042791 A1 Feb. 15, 2018

(51) Int. Cl.
*A61G 7/10* (2006.01)
*A61G 1/003* (2006.01)
(Continued)

(52) U.S. Cl.
CPC ..... *A61G 1/003* (2013.01); *A61G 1/013* (2013.01); *A61G 1/017* (2013.01); *A61G 7/109* (2013.01);
(Continued)

(58) Field of Classification Search
CPC .... A47C 1/02; A47C 4/10; A47C 4/20; A47C 4/14; A47C 4/16; A47C 4/24; A47C 4/26;
(Continued)

(56) References Cited

U.S. PATENT DOCUMENTS 128,423 A * 6/1872 Potter ..... A47O 4/20 297/51
479,355 A * 7/1892 Eldridge ..... A47O 4/24 297/57
(Continued)

FOREIGN PATENT DOCUMENTS

CN 101816601 A 9/2010
CN 201684092 U 12/2010
(Continued)

OTHER PUBLICATIONS

Liftup "State of the Art Lifting Chair" Dec. 18, 2014, XP055220728 http://web.archive.org/web/20141218010623/ http://raizer.com/, Retrieved from the Internet: http://web.archive.org/web/20150220215251/http://raizer.com/media/1391/raizer-by-liftup_vers-2_uk.pdf.
(Continued)

*Primary Examiner* — Kyle J. Walraed-Sullivan
(74) *Attorney, Agent, or Firm* — Woodard, Emhardt, Henry, Reeves & Wagner, LLP

(57) ABSTRACT

There is presented an equipment for raising of an associated lying person, comprising a seat, a primary leg, a secondary leg being secondary leg being rotatably connected to the seat and a backrest, wherein the equipment is arranged to be passed from a first configuration to a second configuration by rotation of the secondary leg around a rotation axis, and wherein the equipment is arranged so that it enables placement of the equipment between the associated lying person and a supporting surface while the bottom of the associated lying person is in contact with the supporting surface upon which the associated lying person is lying and subsequently raising the associated lying person by passing the equipment from the first configuration to the secondary configuration by rotation of the secondary leg. In a particular embodiment,
(Continued)

the equipment is arranged for being reversibly assembled and disassembled without using tools.

35 Claims, 4 Drawing Sheets

(51) Int. Cl.
*A61G 1/013* (2006.01)
*A61G 1/017* (2006.01)

(52) U.S. Cl.
CPC ..... *A61G 7/1011* (2013.01); *A61G 7/1069* (2013.01); *A61G 7/1088* (2013.01); *A61G 7/1038* (2013.01)

(58) Field of Classification Search
CPC .... A47C 4/34; A47C 4/38; A47C 4/44; A47C 4/48; A61G 1/003; A61G 1/013; A61G 1/017; A61G 5/006; A61G 7/10; A61G 7/001; A61G 7/1011; A61G 7/1017; A61G 7/1074; A61G 7/16; A61G 7/165; A61G 7/1069; A61G 7/1088; A61G 7/109; A61G 7/1038
USPC ..... 297/34
See application file for complete search history.

(56) References Cited

U.S. PATENT DOCUMENTS 2,136,838 A * 11/1938 Bosschieter ..... A47O 4/10 297/39
2,362,721 A * 11/1944 Reynolds ..... A61G 1/013 280/47.25
2,394,245 A * 2/1946 Koller ..... A61G 1/003 5/627
2,400,155 A * 5/1946 Letschert ..... A61G 1/017 5/626
3,137,511 A * 6/1964 Weil ..... A61G 5/0858 280/5.24
3,147,039 A * 9/1964 Smith ..... A61G 5/006 297/90
3,271,796 A * 9/1966 Dillman ..... A47C 7/425 5/625
3,921,231 A * 11/1975 Bourgraf ..... A61G 1/003 5/627
4,016,005 A * 4/1977 DiMatteo ..... A61G 5/104 134/30
4,054,959 A * 10/1977 DiMatteo ..... A61G 7/02 5/83.1
4,173,372 A * 11/1979 Norris ..... A61G 15/02 248/421
4,190,913 A * 3/1980 DiMatteo ..... A61G 7/02 5/83.1
4,249,774 A * 2/1981 Andreasson ..... A61G 5/14 297/311
4,393,529 A * 7/1983 Britz ..... A61G 5/00 297/130
4,419,989 A * 12/1983 Herbold ..... A61G 5/006 482/142
4,432,359 A * 2/1984 James ..... A61G 7/1059 297/487
4,470,630 A * 9/1984 Shields ..... A47C 1/14 297/118
D276,107 S 10/1984 Grosfillex
4,837,872 A * 6/1989 DiMatteo ..... A61G 7/053 5/713
4,987,620 A * 1/1991 Sharon ..... A61G 5/006 5/600
4,997,200 A * 3/1991 Earls ..... A61G 5/006 280/304
5,023,968 A * 6/1991 Diehl ..... A61G 1/017 403/102
D320,508 S 10/1991 Klawitter
5,058,948 A * 10/1991 Singer ..... A47C 4/24 297/18
5,090,072 A * 2/1992 Gray ..... A61G 7/1019 5/86.1
5,096,008 A * 3/1992 Mankowski ..... A61G 5/042 180/6.5
5,193,633 A * 3/1993 Ezenwa ..... A61G 5/006 180/271
5,233,708 A * 8/1993 Winston, Sr. ..... A61G 7/1038 280/47.25
5,355,538 A * 10/1994 Fulford ..... A61G 7/1019 5/81.1 R
5,366,036 A * 11/1994 Perry ..... A61G 5/006 180/65.1
D358,945 S 6/1995 Vidal
5,454,126 A * 10/1995 Foster ..... A61G 7/00 5/600
5,500,964 A * 3/1996 Bergersen ..... A61G 7/001 5/607
5,524,303 A * 6/1996 Palmer, Jr. ..... A61G 7/1015 5/507.1
5,572,756 A * 11/1996 Muuranen ..... A61G 1/017 296/20
5,577,279 A * 11/1996 Foster ..... A61G 7/00 5/602
5,596,775 A * 1/1997 DiMatteo ..... A61G 7/001 297/335
5,613,252 A * 3/1997 Yu ..... A61G 7/001 5/88.1
D386,047 S 11/1997 Jarvis
5,704,083 A * 1/1998 Nerg ..... A61G 7/0005 5/600
5,896,602 A * 4/1999 Marblestone ..... A61G 7/1019 5/81.1 HS
5,916,085 A * 6/1999 Wells ..... A61G 7/053 5/608
D413,766 S 9/1999 Hou
5,950,258 A * 9/1999 Deyne ..... A61G 7/10 135/66
6,044,507 A * 4/2000 Smith ..... A61G 7/1038 248/158
6,131,215 A * 10/2000 Lindell ..... A61G 5/006 5/607
6,154,899 A * 12/2000 Brooke ..... A61G 5/006 297/DIG. 4
6,185,761 B1 * 2/2001 Chapman ..... A61G 7/1011 5/81.1 HS
D439,067 S * 3/2001 Vertongen ..... D6/370
D448,243 S 9/2001 Kehrein
6,336,235 B1 * 1/2002 Ruehl ..... A61G 7/00 297/354.13
6,381,781 B1 * 5/2002 Bourgraf ..... A61G 1/0565 296/20
6,427,270 B1 * 8/2002 Blevins ..... A61G 5/006 5/611
6,691,349 B2 * 2/2004 Blevins ..... A61G 5/006 5/613
6,834,402 B2 12/2004 Hanson et al.
D518,303 S * 4/2006 Vira ..... D6/368
7,389,552 B1 * 6/2008 Reed ..... A61G 1/013 296/20
7,578,012 B2 * 8/2009 Palay ..... A61G 3/02 5/81.1 R
7,740,309 B2 * 6/2010 Mayercheck ..... A47C 4/14 297/16.1
8,316,480 B2 * 11/2012 Burak, Jr. ..... A61G 7/1019 5/81.1 HS
D687,234 S 8/2013 Pedersen et al.
8,684,223 B1 4/2014 Kalamaras
8,745,791 B1 * 6/2014 Ullrich ..... A61G 1/017 5/625
D714,589 S 10/2014 Uchida
D718,577 S * 12/2014 Gonzales ..... D7/523
8,955,904 B1 * 2/2015 Zhu ..... A47C 4/28 297/16.1

(56) References Cited

U.S. PATENT DOCUMENTS

| | | | | |
|---|---|---|---|---|
| 9,021,633 | B2 * | 5/2015 | Chun | A61G 7/1019 5/611 |
| 9,084,707 | B2 * | 7/2015 | Patterson | A61G 7/1019 |
| 9,101,520 | B2 * | 8/2015 | Goldish | A61G 5/14 |
| 9,259,370 | B2 * | 2/2016 | Gabriely | A61G 5/00 |
| 9,345,329 | B2 * | 5/2016 | Gendell | A47C 4/04 |
| 9,358,166 | B2 * | 6/2016 | Ferniany | A61G 5/12 |
| 9,364,379 | B2 * | 6/2016 | Hammond | A61G 7/1017 |
| 9,393,167 | B2 * | 7/2016 | Ganel | A61G 5/1002 |
| 2006/0213007 | A1 * | 9/2006 | Palay | A61G 3/02 5/81.1 R |
| 2007/0028381 | A1 * | 2/2007 | Palay | A61G 7/053 5/81.1 R |
| 2010/0001555 | A1 * | 1/2010 | Chen | A47C 4/48 297/46 |
| 2011/0296608 | A1 * | 12/2011 | Victor | A61G 7/1015 5/83.1 |
| 2012/0073051 | A1 * | 3/2012 | Lachenbruch | A61G 7/07 5/610 |
| 2013/0269103 | A1 * | 10/2013 | Van Oirschot | A61G 7/1025 5/83.1 |
| 2014/0070582 | A1 * | 3/2014 | Mastio | A47C 1/033 297/284.2 |
| 2014/0289961 | A1 * | 10/2014 | Patterson | A61G 7/1019 5/88.1 |
| 2015/0290057 | A1 * | 10/2015 | Moller | A61G 1/003 297/34 |
| 2016/0081479 | A1 * | 3/2016 | Lin | A47C 4/14 297/16.1 |
| 2016/0286963 | A1 * | 10/2016 | Yang | A47C 4/44 |
| 2016/0338492 | A1 * | 11/2016 | Piretti | A47C 4/04 |
| 2017/0105527 | A1 * | 4/2017 | Choi | A47C 4/24 |
| 2018/0028383 | A1 * | 2/2018 | Stryker | A61G 1/013 |
| 2018/0078438 | A1 * | 3/2018 | Ferderber | A61G 7/1073 |
| 2018/0168896 | A1 * | 6/2018 | Price | A61G 1/017 |
| 2018/0271731 | A1 * | 9/2018 | Bellingroth | A61G 7/16 |

FOREIGN PATENT DOCUMENTS

| | | | |
|---|---|---|---|
| EP | 0 707 843 | A1 | 10/1995 |
| GB | 2 413 953 | A | 11/2005 |
| JP | 05001342 | U | 1/1993 |
| JP | 2000217884 | | 8/2000 |
| JP | 2000245854 | A | 9/2000 |
| JP | 2001112820 | | 4/2001 |
| JP | 2001258959 | | 9/2001 |
| JP | 2002-17785 | A | 1/2002 |
| WO | WO 02/15834 | A1 | 2/2002 |
| WO | WO 2010/096636 | A1 | 8/2010 |
| WO | WO 2014/063705 | A1 | 5/2014 |

OTHER PUBLICATIONS

Liftup A/S "Raizer by Liftup" Sep. 9, 2014, XP054976144, Retrieved from the Internet: URL: https://www.youtube.com/watch?v=ZzwWeOciNgQ.

International Search Report for PCT/DK2015/050041 dated Oct. 21, 2015.

Japanese Office Action issued in related Japanese Application No. 2017-545314 dated Jan. 29, 2019.

Machine tralslation of JP2001258959 by European Patent Office Patent Translate on Mar. 13, 2019 (pp. 14).

Machine translation of JP05001342U by Lexis Nexis Total Patent on Mar. 13, 2019 (pp. 12).

Machine translation of JP2000217884 by European Patent Office Patent Translate on Mar. 13, 2019 (pp. 37).

Machine translation of JP2001112820 by European Patent Office Patent Translate on Mar. 19, 2019 (pp. 15).

Machine translation of JP2000245854 by European Patent Office Patent Translate on Jul. 17, 2019.

* cited by examiner

METHOD AND EQUIPMENT FOR RAISING A LYING PERSON

CROSS REFERENCE TO RELATED APPLICATIONS

This application is a U.S. National Phase Application of PCT International Application Number PCT/DK2015/050041, filed on Feb. 27, 2015, designating the United States of America and published in the English language. The disclosures of the above-referenced applications are hereby expressly incorporated by reference in their entireties.

FIELD OF THE INVENTION

The present invention relates to equipment for raising an associated lying person, and a corresponding method and use of said equipment.

BACKGROUND OF THE INVENTION

The invention is based on the difficulty related to raise an elderly person or a person with reduced mobility that has fallen on a floor. In particular it concerns elderly person or a person with reduced mobility and do not have sufficient muscles to rise to their feet by their own, or where it will cause consequential damages if the person is trying to get up without assistance. Here it concerns people who are vigorous, and for unknown reasons have a fall or stumble across a piece of furniture or something else. Persons falling over due to a heart attack are another matter. Due to inadequate muscles and resilience of the body, the person will appear with a "dead weight", and it will be difficult even for the nursing staff to raise the person.

Some persons whom, e.g., due to a fall, end up lying on a supporting surface cannot and/or should not get up without assistance. This may be elderly persons or persons with reduced mobility and whom do not have sufficient muscles to rise to their feet by their own, or where it will cause consequential damages if the person is trying to get up without assistance. Such persons be difficult or physically challenging for assisting persons, such as nursing staff, to raise.

Equipment such as lifts for handling of physically weakened persons is known. It can be crane-like lifts running on wheels or ceiling lifts, where the lift is running on a rail fixed in the ceiling or to a special frame. However, these lifts are not particularly practicable to raise a person who has fallen on the floor.

SUMMARY OF THE INVENTION

It may be seen as an object of the present invention to provide an equipment that enables raising an associated lying person, wherein the equipment can be moved without having to lift heavy parts, wherein the equipment can be operated and used for raising an associated lying person without having to lift the associated lying person or heavy parts of the associated lying person, wherein the equipment is relatively compact, and/or relatively simple.

It is a further object of the present invention to provide an alternative to the prior art.

Thus, the above-described object and several other objects are intended to be obtained in a first aspect of the invention by providing an equipment for raising of an associated lying person, such as the associated lying person being a person lying on the back, the equipment comprising, such as comprising when in use:

a seat, a primary leg, wherein the primary leg is connected to the seat and having a portion extending in a primary direction away from the seat, a secondary leg, wherein the secondary leg is rotatably connected to the seat and having a portion extending in a secondary direction away from the seat, a backrest, wherein the backrest is connected to the seat and having a portion extending away from the seat in a tertiary direction, wherein the secondary leg is arranged for rotation around a rotation axis, wherein the equipment is arranged to be passed from a first configuration to a second configuration by rotation of the secondary leg around the rotation axis, wherein an angle between the primary direction and the secondary direction decreases during said rotation, and wherein the equipment is arranged so that it enables placement of the equipment in the first configuration at least partially between the associated lying person and a supporting surface upon which the associated person is lying, such as at least partially below the associated lying person, while the bottom of the associated lying person is in contact, such as uninterrupted contact, with a supporting surface upon which the associated lying person is lying and subsequently raising the associated lying person by passing the equipment from the first configuration to the secondary configuration by rotation of the secondary leg.

It is to be understood that the terms "bottom" and "buttocks", when referring to the anatomy of a person, are used interchangeably throughout the specification and as claimed.

It may in particular be seen as an advantage of the present invention, that it provides an equipment, which enables raising a person, such as raising a person by rotation of the secondary leg. Thus, the equipment may facilitate, that an assisting person can place the equipment at least partially below (where below is understood with reference to gravity as is common in the art) the associated lying person, such as below the back and thighs of the associated lying person, without having to displace the bottom of the associated lying person, and then subsequently raise the associated lying person by rotation of the secondary leg. The rotation may be carried out manually, e.g., via a gear unit, or in a motorized manner. Thus, the assisting person need not apply a force corresponding to a force required to vertically displace the bottom of the associated lying person, let alone apply a force corresponding to the weight of the associated lying person. The raising can optionally be carried out merely by the rotation of the secondary leg.

It may thus be understood, that said placement may be carried out without substantial displacement, such as any displacement, of the buttocks of the associated lying person in a vertical direction, such as without any displacement of the buttocks of the associated lying person. This is advantageous, since this enables that an assisting person need not lift the pelvic region, which region may typically be a relatively heavy portion of the associated lying person.

In other words, the equipment facilitates a process of raising the associated lying person, which process involves placing the equipment at least partially below the associated lying person but without lifting the bottom of said person from the supporting surface, and then subsequently raising the associated lying person by rotation of the secondary leg, where said rotation may relatively easily be carried out in a geared or motorized manner.

It may be seen as an advantage of the present invention that it enables moving the equipment to a position under the associated person (without moving the bottom of the associated person), so as to dispense with the need to move the associated person onto equipment for raising the associated person. In an embodiment, this may be realized by assembling the equipment around the person. In another embodiment, this may be realized by reconfiguring different parts of the equipment after placing at least a part of the equipment below the associated person.

By 'raising the associated lying person' may be understood that the associated lying person is raised from a lying configuration to a sitting configuration, such as wherein the bottom is displaced vertically in an upwards direction and wherein an angle between the back and a vertical axis is decreased.

'Bottom' of the associated lying person is understood as is common in the art, and may be specified to be the posterior of the pelvic region.

The associated lying person may be a normal person, such as a normal adult person, such a person with all limbs intact and weighing 75 kg and being 175 cm.

By 'supporting surface' may in general be understood the surface upon which the associated lying person is lying when being in an initial lying position (i.e., before being raised). The supporting surface may for example be a floor when indoors or the ground when outdoors.

When referring to 'associated lying person' it is understood that this person is initially —such as before commencing raising—lying down, but is subsequently raised. It is also understood, that reference is made to the 'associated lying person', although this person may not be lying down during or subsequent to raising.

When referring to 'directions' of the primary leg, secondary leg and backrest, it is generally understood to be directions in a plane being orthogonal to the rotation axis.

Each of the 'primary leg' and the 'secondary leg' may comprise one or more, such as two, primary respectively secondary sub-legs. For example a primary and/or secondary sub-leg on each side of the equipment, said sub-legs being displaced along the rotation axis, such as enabling having a sub-leg on both a left and right side of the associated lying person.

When referring to 'angle' between two entities, such as between two directions or between two planes or between a plane and a direction (such as a vector), it is to be understood, that said angle is the smallest angle between said entities.

In an embodiment, the equipment is arranged so that it enables that, while the bottom of the associated lying person is in contact with the supporting surface:

- the backrest may be positioned below the back of the associated lying person,
- the seat may be positioned below the legs, such as the thighs, of the associated lying person.

A possible advantage of placing both backrest and seat below the associated lying person may be, that it enables supporting the associated lying person on both sides of the center of gravity of the associated lying person. Another advantage may be that it enables not only lifting the associated lying person, but also changing the configuration from a lying (straight) configuration to a sitting configuration during said raising.

In an embodiment, the equipment is arranged so that there is an absence of material, such as a through-going, between the seat and the backrest, such as so that a bottom of the associated lying person can be in contact with the supporting surface when

- the backrest is positioned below the back of the associated lying person,
- the seat is positioned below the legs, such as the thighs, of the associated lying person.

A possible advantage of having this absence of material, which may be through-going hole or an indentation (such as an indentation when observed from a position above the equipment when the equipment is in a first configuration), may be that this absence of material enables that no material of the equipment needs to be placed between the bottom of the associated lying person when the equipment is brought in a first configuration and a position below the associated lying person. More specifically, the absence of material enables that the equipment can be brought in a first configuration and a position below the associated lying person—ready for raising the associated lying person by rotation of the secondary leg—while a virtual line may be drawn from the pelvic region, such as from a point between the hip-joints, and down to the supporting surface along a vertical line without intersecting or touching any material of the equipment.

In an embodiment, an angle between the secondary direction and the tertiary direction increases during said rotation. An advantage of this may be that it enables erecting the back of the associated lying person.

In an embodiment, Equipment for raising of an associated lying person according to any one of the preceding claims, wherein a largest distance $d_{12}$ between

- a point in the primary leg, and
- a distal point (P) in the secondary leg, where the distal point (P) is the point in the secondary leg which is furthest away from the rotation axis,
- at least in the first position is larger, such as at least 10% larger, such as at least 25% larger, such as at least 50% larger, such as at least 75% larger, such as at least 100% larger, such as more than 100% larger, than the distance $d_2$ between
- the rotation axis, and
- the distal point (P) in the secondary leg.

A possible advantage of having $d_{12}$ being larger than $d_2$ is that it enables that a distance between points of interaction with a supporting surface is relatively large compared with a length of the secondary leg. Thus, a relatively compact secondary leg, which may facilitate in yielding a relatively light and/or compact equipment, and still support a relatively stable equipment due to the relatively large distance between supporting points. For example, the equipment may be arranged so that the primary and secondary legs do not necessarily cross each other, such as do not necessarily cross each other during movement from the first configuration to the second configuration. For example, the equipment may be arranged so that the secondary leg is attached to the seat via a secondary joint, and the primary leg is attached to the seat via a primary joint, and

- a direction from the primary joint to the secondary joint is an opposite direction relative to the primary direction, and
- a direction from the secondary joint to the primary joint is an opposite direction relative to the secondary direction.

By opposite direction, may in general be understood 'more than 90 degrees'.

In an embodiment, the secondary leg is coupled to the seat via a pivot joint at one end of the secondary leg, such as an upper end of the secondary leg, and wherein the rotation axis is coincident with the pivot joint. It may thus be understood, that the rotation axis is the axis of the pivot joint, which couples the rigid secondary leg to the seat.

In an embodiment, the rotation axis is at one end of the secondary leg (5), such as at the end nearest the seat (1), and wherein a distance $d_2'$ between the rotation axis, and a furthest point in the primary leg on the opposite side of the rotation axis than the distal point (P) in the secondary leg (5), is smaller, such as less than 75%, such as less than 50%, such as less than 25%, such as less than 10%, compared to $d_2$.

An advantage of this may be that it enables that a large portion (such as the length $d_2$) of the length of the secondary leg (such as the total length $d_2+d_2'$) is utilized on the portion between the rotation axis and the end point P, so that a relatively short leg still provides a relatively large distance between the rotation axis and a point P at the end of the leg. In other words, no or little length is wasted on the opposite side of the rotation axis.

In an embodiment, one or more parts of the equipment, such as one or more or all of the primary leg (4), the secondary leg (5) and the backrest (2), are arranged for disconnection and re-connection to another part of the equipment, such as the seat (1), in a reversible manner. A possible advantage of having an equipment which may be reversibly assembled and disassembled, may be that it enables transporting the equipment without necessitating lifting at once the entire weight of the equipment, since different parts of equipment can be taken one by one. Another possible advantage may be that the equipment may be arranged more compactly during transport when disassembled. It may thus be understood, that by arranging the so that it may be reversibly assembled and disassembled, a solution is provided to the problem of reducing the maximum weight which has to be lifted when the equipment is to be moved, such as carried, from one place to another. Said disconnection and/or re-connection may be performed by an associated assisting person within a limited amount of time, such as within 10 minutes, such as within 5 minutes, such as within 2 minutes, such as within 1 minute.

In a further embodiment, said disconnection and re-connection may be carried out by an associated assisting person without using tools. A possible advantage of this may be, that it enables relatively easily assembling and dissembling the equipment. By 'without using tools' is understood, that the disconnection and re-connection can be carried out with the bare hands, such as with the bare hands of a normal person. It may furthermore be understood, that said disconnection and re-connection, such as the equipment may be disconnected and/or reconnected by an associated assisting person without using tools, within a limited amount of time, such as within 15 minutes, such as within 12 minutes, such as within 10 minutes, such as within 8 minutes, such as within 6 minutes, such as within 5 minutes, such as within 3 minutes such as within 2 minutes, such as within 1 minute.

In a further embodiment, said (reversible) disconnection and re-connection is facilitated by a joint comprising i) a male part on a first part of the equipment, and ii) a female part on a second part of the equipment.

In a further embodiment, different parts of the equipment are kept together by a transition fit, such as a reversible friction fit. By a 'transition fit' is understood a fit where the parts to be held together are held securely, yet not so securely that it cannot be disassembled, such as disassembled without tools, such as disassembled by the hands a human, such as a normal person.

In a further embodiment, different parts of the equipment are kept together by a mechanical locking member, such as one or more or all of:

A pin, such as a split pin, or a spring pin

A click-lock, such as a lock wherein a spring loaded engagement member positioned on one part engages with a cavity or edge on another part upon assembly, so that the spring force has to be overcome before disassembly A detent ball, A hand-operable screw, such as A tommy screw, or A wing screw.

It may be understood, that any of the mechanical locking members may serve to retain the parts together, but also that any of the mechanical locking members may be overcome or removed without tools, such as by the hands of a human, such as a normal person.

In an embodiment, there is presented an equipment, which may be disassembled into separate parts, wherein each separate part is weighing less than 20 kg, such as less than 18 kg, such as less than 15 kg. In an embodiment, there is presented an equipment, which may be disassembled into separate parts, wherein each separate part is weighing less than 12 kg, such as less than 11 kg, such as less than 10 kg, such as less than 9 kg, such as less than 7 kg. A possible advantage of relatively low weight, may be that less weight has to be lifted when moving the equipment. The relatively low weight of the separate parts may be realized by having an equipment, which may be separated into smaller parts and/or by choosing low-weight materials. It is understood that 'kg' is kilogram.

In an embodiment, there is presented an equipment, which further comprises a drive unit for the rotation, such as the drive unit being driven by a motor, such as the drive unit being driven by an electric motor, such as a DC motor, such as a servomotor. A possible advantage of having a drive unit may be that such drive unit can assist an associated assisting person in raising the associated lying person, such as enabling that the associated assisting person does not have to exert a force corresponding to or larger than a force for lifting the bottom of the associated lying person. A possible advantage of having a motorized drive unit may be that it reduces or eliminates the need for having a force applied by the associated assisting person during the rotation.

In an embodiment, there is presented an equipment, which further comprises an energy storage unit operably connected to the drive unit, such as a battery, such as a battery enabling at least 10 sequential raising operations, such as at least 20 sequential raising operations, such as at least 30 sequential raising operations, such as at least 40 sequential raising operations, such as at least 50, such as at least 60 sequential raising operations, such as at least 70 sequential raising operations, such as at least 80 sequential raising operations, such as at least 90 sequential raising operations, such as at least 100 sequential raising operations.

A possible advantage of having such energy storage unit, may be that it enables dispensing with the need of having access to an external source of energy, such as a socket outlet.

In an embodiment, the equipment comprises a traversing element with a drive unit for driving the rotation, the drive unit being an electromotor, and a battery operably connected to the drive unit.

In an embodiment, a structural strength of the equipment enables raising of persons with a body mass of 75 kg or more, such as 100 kg or more, such as 125 kg or more, such as 150 kg or more. It may thus be understood that it at least enables lifting persons with a body mass of 75 kg, such as persons with a body mass of 25 kg, 50 kg or 75 kg.

In an embodiment, there is presented an equipment, which further comprises a remote controller, such as a remote controller enabling an associated assisting person to control the equipment without being in physical contact with the equipment. By a 'remote controller' may be understood any unit capable of communicating with the equipment, such as for controlling the rotation, which unit is not rigidly connected to the equipment. The remote controller may be communicatively connected to the equipment, such as operably connected to the drive unit, via a wireless connection or via a non-rigid electrically or optically conducting physical connection, such as a via a cord, such as a spiral cord.

In an embodiment, the equipment is arranged so that a rotation of the secondary leg (5) around the rotation axis entails that the equipment is passed from the first configuration to the second configuration, during which passing a distal portion of the primary leg (4) engages with a supporting surface of the lying person at a primary side of the seat a distal portion of the secondary leg (5) engages with a supporting surface of the lying person at a secondary side of the seat, where the secondary side of the seat is opposite of the first side of the seat, and wherein during the passing from the first configuration to the second configuration the decreasing angle between the primary direction and the secondary direction during said rotation, entails that a distance between the seat and the supporting surface increases, and an angle between the tertiary direction and the vertical direction decreases.

By 'engaging' may be understood that different elements comes into contact, such as comes into contact and exerts forces on each other.

An advantage of having that a distance between the seat and the supporting surface increases, may be that it enables raising the bottom of the associated lying person. An advantage of having that an angle between the tertiary direction and the vertical direction decreases may be that it enables erecting the back of the associated lying person. An advantage of having that an angle between the tertiary direction and the vertical direction decreases may be that it enables that the backrest exerts a normal force on the associated lying person which has a component in a horizontal direction, such as a horizontal direction towards the seat, so that the seat can support the bottom of the associated person by applying a normal force with a horizontal component in the opposite direction.

In an embodiment, there is presented an equipment, wherein in the first configuration of the equipment (i.e., before raising the associated lying person), an angle between the primary direction and the tertiary direction is more than 90 degrees, such as more than 120 degrees, such as more than 150 degrees, such as substantially 180 degrees, such as 180 degrees. A possible advantage of having this angle, such as by having the primary leg and the backrest pointing in opposite directions, may be that it facilitates having a compact and/or light equipment, since it enables attaching them to the same, relatively compact unit, such as a traversing element, and still having their endpoints separated by approximately the sum of their lengths. Furthermore, the equipment in the first configuration may be kept relatively flat and elongated since the backrest and primary leg are both extended substantially along the same axis, albeit in substantially opposite directions.

In an embodiment, there is presented an equipment, wherein in the first configuration of the equipment, an angle between the secondary direction and the tertiary direction is less than 90 degrees, such as less than 60 degrees, such as less than 30 degrees, such as approximately 0 degrees, such as 0 degrees. A possible advantage of having this angle may be that the equipment in the first configuration may be kept relatively flat and elongated since the backrest and secondary leg are both extended substantially along the same axis.

In an embodiment, there is presented an equipment, wherein an angle between the secondary direction and the tertiary direction is substantially constant, such as constant during said rotation, such as wherein the angle between the secondary direction and the tertiary direction is at least 90 degrees, such as at least 135 degrees, such as at least 160 degrees such as at least 175 degrees, such as substantially 180 degrees, such as 180 degrees. A possible advantage of having this angle constant may be that it facilitates a rigid connection between the backrest and the primary legs, which in turn facilitates a relatively simple, yet stable construction. It may also be seen as an advantage that it facilitates that the only moving part (with respect to the other parts) is the secondary leg.

In an embodiment, at least one of the backrest and the primary leg can be rotated, such as rotated when the equipment is not in use, so that all of the backrest, the primary leg and the secondary leg can be brought in a configurations where each of the primary, secondary and tertiary directions are substantially parallel, such as parallel, and optionally substantially in the same plane, such as in the same plane. An advantage of this may be that the equipment may be brought into a relatively compact configuration when not in use (even without disconnecting any parts).

In an embodiment, there is presented an equipment, which further comprises a traversing element (6), such as a through traversing element which is connected to each one of the seat, the primary leg, the secondary leg, the backrest, such as the traversing element comprising a housing optionally comprising a drive unit (optionally connected to brackets on the outsides of said housing) for driving the rotation and optionally an energy storage unit operably connected to the drive unit. The seat may be placed on or integrated into the traversing element. Each of the primary leg, secondary leg and backrest may be attached to and pointing away from the traversing element. A possible advantage of having a through traversing element is that is improves structural stability.

In an embodiment, the equipment comprises a traversing element where a seat may be placed on or integrated into the traversing element, and where each of the primary leg, secondary leg and backrest may be attached to and pointing away from the traversing element, and wherein the traversing element is comprising a housing, a drive unit and an energy storage unit operably connected to the drive unit. This may be advantageous since said traversing element may relatively compact and light and may relatively easily be pushed under the thighs of the associated lying person, and may subsequently provide the power for raising said person via rotation of the secondary leg.

In an embodiment, there is presented an equipment, wherein the seat is optionally fixedly mounted on the traversing element or being part of the traversing element, the primary leg is connected to the traversing element, such as connected through a male and female connection where an axis of the male and female connection is substantially orthogonal, such as orthogonal, with the rotation axis, and optionally parallel with the primary direction, and wherein the male and female connection optionally comprises a detent ball, the backrest is connected to the traversing element, such as connected through a male and female connection where an axis of the male and female connection is substantially orthogonal, such as orthogonal, with the rotation axis, and optionally parallel with the tertiary direction, and wherein the male and female connection optionally comprises a detent ball, and/or the secondary leg is connected to the traversing element, such as connected through a male and female connection where an axis of the male and female connection is substantially parallel, such as parallel, with the rotation axis, such as mounted on a bracket at the end of the traversing element, wherein the traversing element optionally comprises a drive unit and wherein the bracket is on the end of the drive unit.

In an embodiment, the backrest comprises two separate parts which are connected to the equipment at different positions separated from each other in a direction being parallel with the rotation axis. A possible advantage of this may be that it facilitates placing the backrest under the back of the associated lying person. For example, if said person is lying on the back, then a first separate backrest part can be placed under the right side of the back of said person and subsequently a second separate backrest part can be placed under the left side of the back of said person. Thus, left force has to be applied since the entire back of said person need not be lifted at once.

According to a second aspect, the invention relates to use of an equipment according to the first aspect for raising a lying person.

According to a third aspect, the invention relates to a method for raising an associated lying person, which associated lying person is initially lying on an associated support surface, such as wherein said person is initially lying on the back, said method comprising:

Placing a seat (1) below the legs, such below the thighs, of the associated lying person while a bottom of the associated lying person is in contact, such as uninterrupted contact, with a supporting surface upon which the associated lying person is lying, Placing a backrest (2) between a back of the associated lying person and the associated support surface while the bottom of the associated lying person is in contact, such as uninterrupted contact, with a supporting surface upon which the associated lying person is lying, Connecting the backrest (2) to the seat (1), such as so that the backrest is having a portion extending away from the seat in a tertiary direction, Connecting a secondary leg (5) to the seat (1), wherein the secondary leg (5) is connected rotatably to the seat (1) and having a portion extending in a secondary direction away from the seat, Connecting a primary leg (4) to the seat (1) so that the primary leg (4) is having a portion extending in a primary direction away from the seat, Raising the associated person by rotation of the secondary leg (5) from a first angular position of the secondary leg (5) to a second angular position of the secondary leg (5) wherein an angle between the primary direction and the secondary direction decreases during said rotation.

It may be seen as advantageous, that the method facilitates that an assisting person can raise the associated lying person without applying a force large enough to lift the bottom of the associated lying person until the rotation of the secondary leg, which rotation can be carried out, e.g., by a geared movement or via a drive unit, such as an electromotor. Thus, the method may be seen as enabling that equipment, such as the different structural parts (seat, primary leg, secondary leg, backrest) can be placed under the associated lying person rather than necessitating that the bottom or even the entire body of the associated lying person is placed (lifted) onto an equipment for raising the person.

In an embodiment there is presented a method, where a largest distance $d_{12}$ between a point (such as any point, such as the point furthest away) in the primary leg (4), and a distal point (P) in the secondary leg (5), where the distal point (P) is the point in the secondary leg (5) which is furthest away from the rotation axis, at least in the first angular position is larger, such as at least 10% larger, such as at least 25% larger, such as at least 50% larger, such as at least 75% larger, such as at least 100% larger, such as more than 100% larger, than the distance $d_2$ between the rotation axis, and the distal point (P) in the secondary leg (5)

An advantage of this may be that it improves stability by facilitating for a given set of legs a maximum distance between points of supports (such as the ends of legs).

In an embodiment there is presented a method wherein the backrest is having a portion extending away from the seat in a tertiary direction, and an angle between the secondary direction and the tertiary direction increases during said rotation.

In an embodiment, the method further comprises rotating the secondary leg (5) so that the secondary leg is passed from a first angular position to a second angular position, during which passing a distal portion of the primary leg (4) engages with the associated support surface of the lying person at a primary side of the seat (1), a distal portion of the secondary leg (5) engages with the associated support surface of the lying person at a secondary side of the seat (1), where the secondary side of the seat (1) is opposite of the first side of the seat (1), and so that during the passing from the first angular position to the second angular position the decreasing angle between the primary direction and the secondary direction during said rotation entails that a distance between the seat (1) and the supporting surface increases, and an angle between the tertiary direction and the vertical direction decreases.

In an embodiment there is presented a method, wherein the associated lying person is raised by said rotation of the secondary leg (5), and wherein the bottom of the associated lying person is kept in contact with the supporting surface until the associated lying person is raised by rotation of the secondary leg (5), such as wherein the method involves no substantial displacement, such as any displacement, of the bottom of the associated lying person in a vertical direction, such as without any displacement of the bottom of the associated lying person, before associated lying person is raised by rotation of the secondary leg (5).

In an embodiment there is presented a method, wherein one or more or all of:

Connecting the backrest to the seat,

Connecting the secondary leg to the seat,

Connecting the primary leg (4) to the seat, takes place after

Placing the seat (1) below the legs, such as the thighs, of the associated lying person.

An advantage of connecting one or more parts to the seat after placing the seat below the legs, may be that it facilitates assembling equipment for raising the associated lying person around the person, which in turn facilitates that such equipment may be provide below legs and back of the associated person while the bottom is kept in contact, such as uninterrupted contact with the supporting surface. In other words, it may enable that equipment for raising the associated lying person can be provided—without having to lift the bottom of the associated lying person—at least partially below said person in a functional condition for raising the associated lying person.

In an alternative embodiment, one or more parts are arranged for relative movement with respect to the other parts, so that the equipment can be reconfigured after being placed at least partially below the associated lying person, e.g., separate backrest parts can be rotated around an axis close to the seat, which axis is parallel with the rotation axis of the secondary leg, and furthermore rotated around their longitudinal direction, so that they can be placed under the back of the person after placing the seat under the thighs.

In an embodiment there is presented a method, wherein after raising of the associated lying person, the method further comprises, Optionally rotating the second leg (4) so that it assumes the initial angular position, and wherein the method furthermore comprises, such as subsequently comprises, one or more or all of Disconnecting the backrest (2) from the seat (1), Disconnecting the secondary leg (5) from the seat (1), Disconnecting the primary leg (4) from the seat (1).

A possible advantage of disconnecting one or more of the backrest, secondary leg, primary leg, from the seat, may be that it enables reducing the weight, such as the maximum weight, which has to be handled, such as lifted, when moving the equipment after raising of the associated lying person. A possible advantage of rotating the second leg (4) so that it assumes the initial angular position before disconnecting the primary leg and or the secondary leg, may be that it enables bringing the equipment in a condition where it is not supported by the primary leg and/or the secondary leg, so that when disconnecting the primary leg and/or the secondary leg, then the equipment is supported in the same position before/after said this disconnection.

The first, second and third aspect of the present invention may each be combined with any of the other aspects. These and other aspects of the invention will be apparent from and elucidated with reference to the embodiments described hereinafter.

BRIEF DESCRIPTION OF THE FIGURES

The equipment, use and method according to the first, second and third aspect of the invention will now be described in more detail with regard to the accompanying figures.

The figures show one way of implementing the present invention and is not to be construed as being limiting to other possible embodiments falling within the scope of the attached claim set.

DETAILED DESCRIPTION OF AN EMBODIMENT

Figure 1:
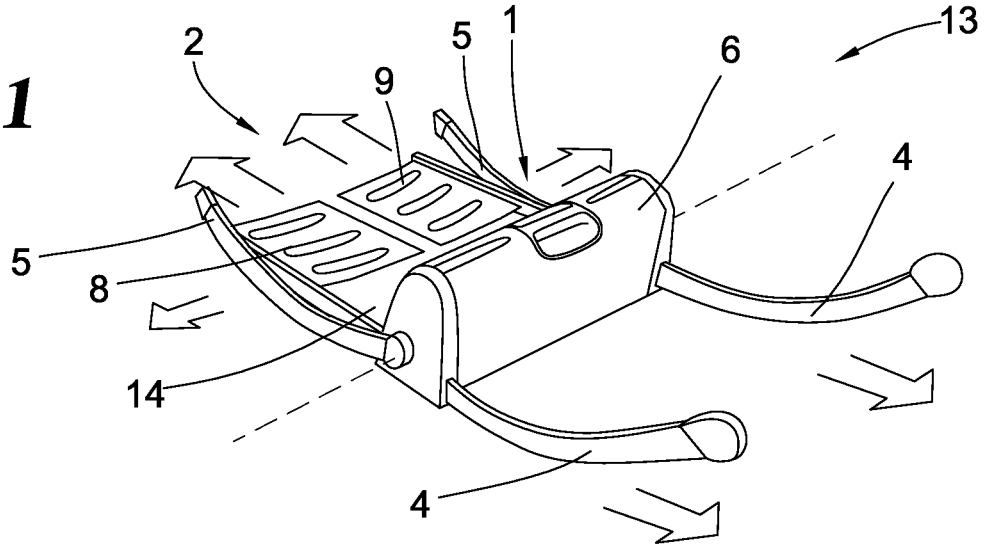
FIG. 1 shows a perspective view of an equipment 13 for raising of an associated lying person.

FIG. 1 shows a perspective view of an equipment 13 for raising of an associated lying person, such as the associated lying person being a person lying on the back, the equipment comprising:

a seat 1, a primary leg 4, wherein the primary leg in this embodiment comprises two sub-legs with one sub-leg on each side of the equipment (and analogously for the primary leg 4), wherein the primary leg 4 is connected to the seat 1 and having a portion extending in a primary direction away from the seat, a secondary leg 5, wherein the secondary leg 5 is rotatably connected to the seat 1 and having a portion extending in a secondary direction away from the seat, a backrest 2, wherein the backrest 2 is connected to the seat 1 and having a portion extending away from the seat in a tertiary direction, and wherein the backrest 2 comprises two separate parts 8, 9 which are connected to the equipment at different positions separated from each other in a direction being parallel with the rotation axis.

wherein the secondary leg 5 is arranged for rotation around a rotation axis (said rotation axis being shown in the figure with a dashed line), wherein the equipment is arranged to be passed from a first configuration to a second configuration by rotation of the secondary leg 5 around the rotation axis, wherein an angle between the primary direction and the secondary direction decreases during said rotation, and wherein the equipment is arranged so that it enables placement of the equipment in the first configuration at least partially between the associated lying person and a supporting surface upon which the associated person is lying, such as at least partially below the associated lying person, while the bottom of the associated lying person is in contact, such as uninterrupted contact, with a supporting surface upon which the associated lying person is lying and subsequently raising the associated lying person by passing the equipment from the first configuration to the secondary configuration by rotation of the secondary leg 5.

The equipment in FIG. 1 furthermore comprises a traversing element 6 where the seat is integrated into the traversing element as the surface of the traversing element facing the backrest 2, and where each of the primary leg, secondary leg and backrest are attached to and pointing away from the traversing element, and wherein the traversing element is comprising a housing. A drive unit and an energy storage unit operably connected to the drive unit is placed inside the housing so that it can power rotation of the secondary leg and thereby raise an associated lying person by activation of the drive unit.

All of the primary leg 4, the secondary leg 5 and the backrest 2, are arranged for disconnection and re-connection to the traversing element in a reversible manner. This is indicated by the thick, arrows, which indicate the direction in which the part adjacent said arrow may be disconnected from the traversing element (and reconnected by movement in the opposite direction). Said disconnection and re-connection may be carried out by an associated assisting person without using tools.

Figure 2:
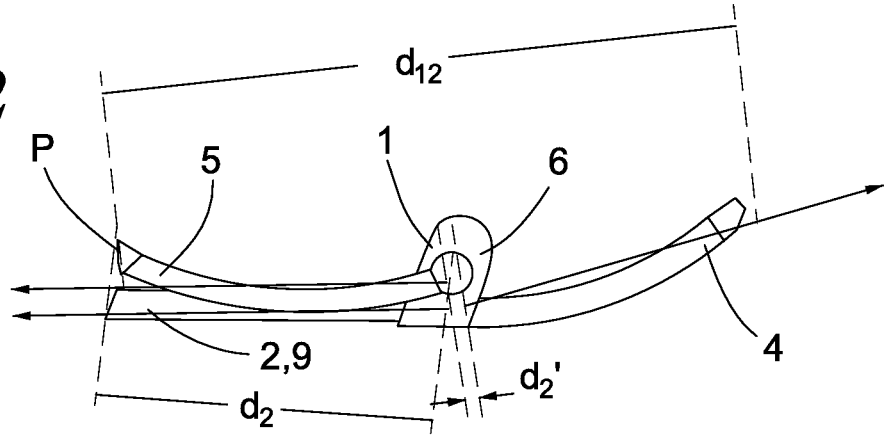
FIG. 2 shows a side view from a point along the rotation axis of the equipment depicted in FIG. 1

FIG. 2 shows a side view from a point along the rotation axis of the equipment depicted in FIG. 1. FIG. 2 indicates point P, distances $d_{12}$, $d_2$, $d_2'$, and the three arrows—which represent vectors—indicate, respectively the primary, secondary and tertiary direction, for the primary leg 4, the secondary leg 5 and the backrest 2. The directions are given by the direction of the longitudinal axis, such as the axis of minimum moment of inertia, of each of said parts. The figure shows that the primary direction is substantially opposite both the secondary and tertiary direction, and that the secondary and tertiary directions are substantially parallel.

The equipment in FIGS. 1-2 is shown in a first configuration, wherein the equipment may be placed at least partially below an associated lying person, such as the traversing element 6 with seat 1 under the thighs, and at least a portion of the backrest 2 under the back of the associated lying person. The absence 14 of material is arranged so that the bottom of the associated lying person fits into this absence of the material, so that the equipment 13 can be placed at least partially below, such as assembled at least partially below, the associated lying person without lifting the bottom of the associated lying person of the ground.

Figure 3:
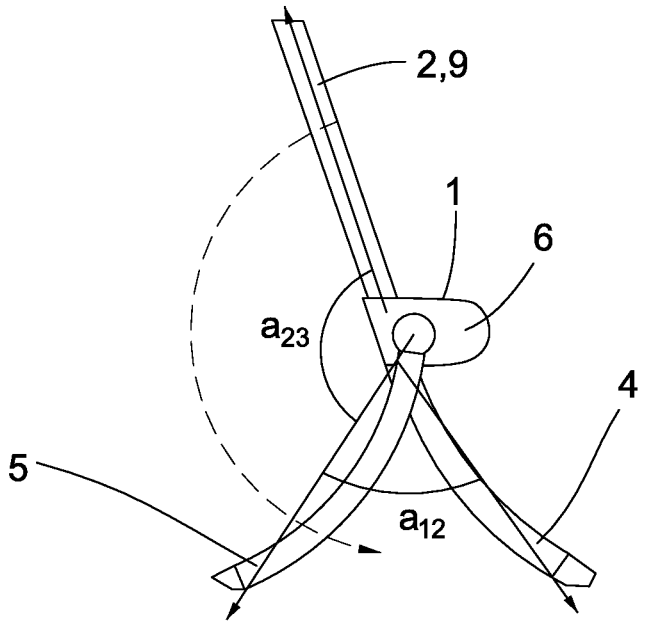
FIG. 3 shows another side view of the equipment with the same perspective as in FIG. 2, but with the equipment passed to the second configuration.

FIG. 3 shows another side view of the equipment with the same perspective as in FIG. 2, but with the equipment passed to the second configuration. The equipment in the second configuration is configured as a chair, so that the associated lying person can be brought to sit in an upright position. The equipment may be passed from the first configuration to the second configuration by rotation—as indicated by the curved and dashed arrow—of the secondary leg. The figure also shows that said rotation entails that an angle $a_{12}$ between the primary direction and the secondary direction decreases during said rotation, and an angle $a_{23}$ between the secondary direction and the tertiary direction increases during said rotation.

FIGS. 4-12 illustrates a method of raising an associated lying person 15.

Figure 4:
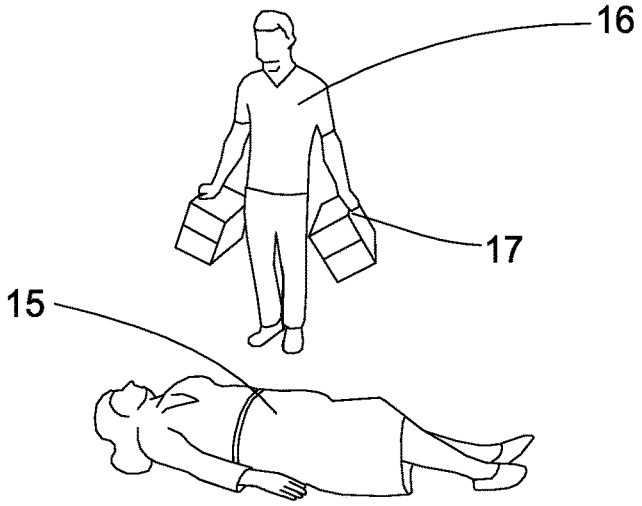
FIGS. 4-12 illustrates a method of raising an associated lying person 15.

FIG. 4 shows an associated assisting person 16, such as personal care worker, whom in the present example is male and hereafter referred to as 'he' or 'him'. He arrives to an associated lying person 15, whom in the present example is female and hereafter referred to as 'she' or 'her'. He carries equipment for raising her, which equipment is disassembled so that he need not carry the entire weight of the equipment at once.

Figure 5:
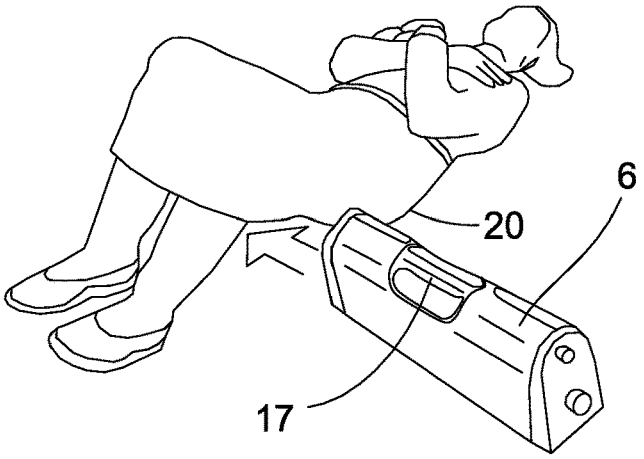

FIG. 5 shows that the traversing element 6 which in a sliding motion as indicated by the thick arrow is placed under the thighs of her without lifting her bottom 20, which is resting on a supporting surface. The side of the traversing element adjacent the bottom 20 double functions as a seat. The traversing element has a side, which is planar so that the traversing element can be stably placed on the floor. The traversing element also features a handle 17 for easy handling. The side of the traversing element opposite the handle is planar.

Figure 6:
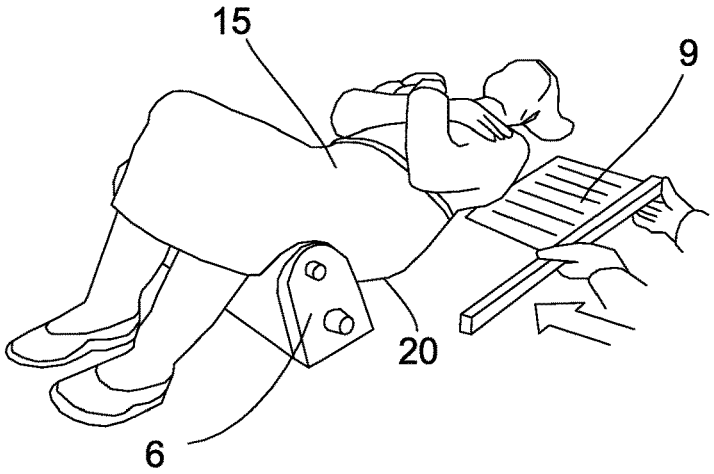

FIG. 6 shows that her shoulder is gently turned by pushing her elbow, and the backrest part 9 is gently placed below her back, more specifically her shoulder, in a sliding motion. Her buttocks 20 remain resting on and in contact with the supporting surface during this placement of the backrest part 9.

Figure 7:
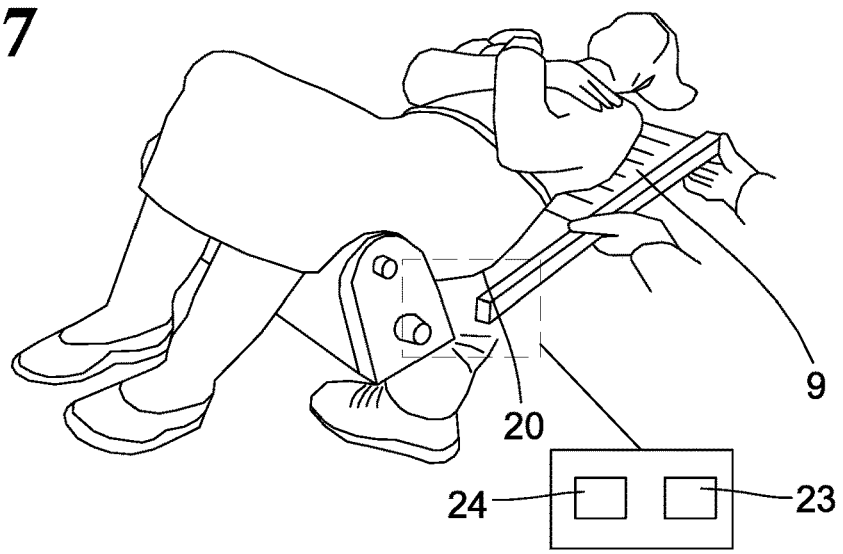

FIG. 7 shows that the backrest part 9 is connected to the seat via the traversing element via a male-female coupling with a spring pin. A close up view shows the male part 23 of the male-female coupling and the female part 24 of the male-female coupling. His foot is placed on the other side of the traversing element to ensure that it stays in place.

Figure 8:
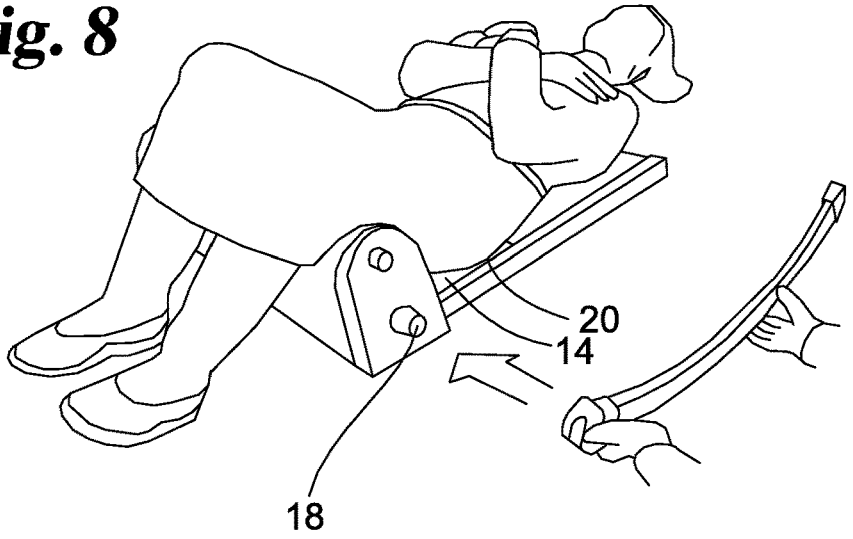

FIG. 8 shows that a sub-leg of the secondary leg is connected to the seat via a bracket 18 on a side of the traversing element. A click-lock arrangement ensures that the sub-leg stays in place during the subsequent raising and it may be seen in this drawing that after this connection, her buttocks 20 are located within the area of the absence 14 of material.

Figure 9:
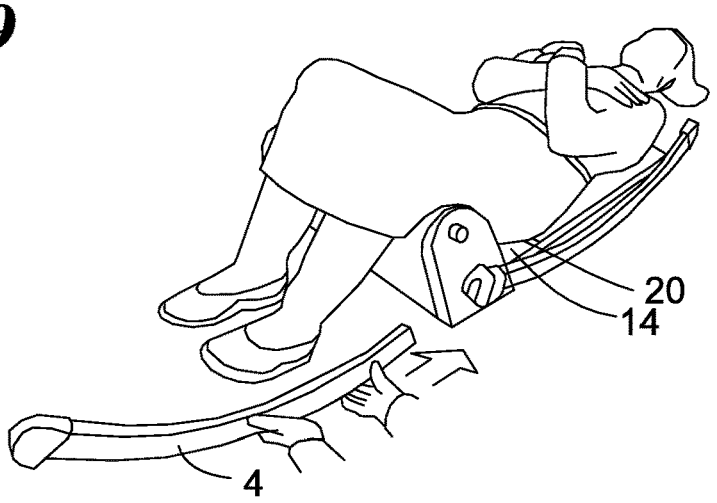

FIG. 9 shows that a sub-leg of the primary leg 4 is connected to the seat via the traversing element via a male-female coupling with a spring pin.

Thus, FIGS. 6-9 illustrates connection of the right side sub-parts of the primary leg, secondary leg and backrest to the seat via the traversing element. In analogy herewith, the method also features connection of the symmetrical left side sub-parts of the primary leg, secondary leg and backrest to the seat via the traversing element. This is not shown in the figures.

Figure 10:
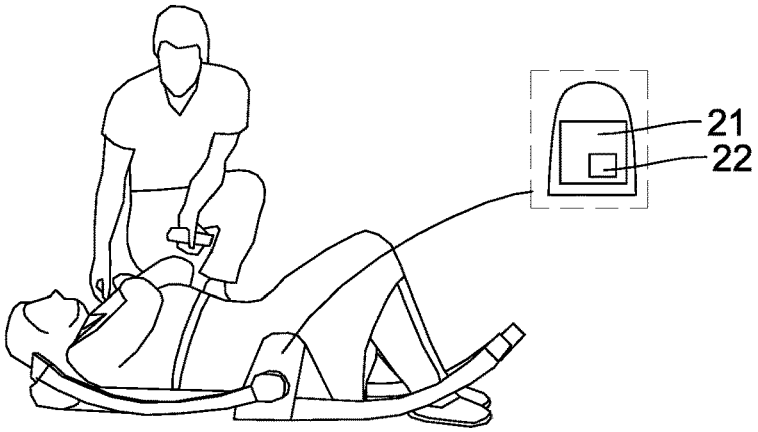

FIG. 10 shows the associated lying person, with the equipment placed below her, although her bottom is in contact with the floor and the equipment being in the first configuration and ready for raising her. The traversing element 6 comprises a motorized drive unit 21 and an energy storage unit 22 for raising the associated lying person by rotation of the secondary leg.

Figure 11:
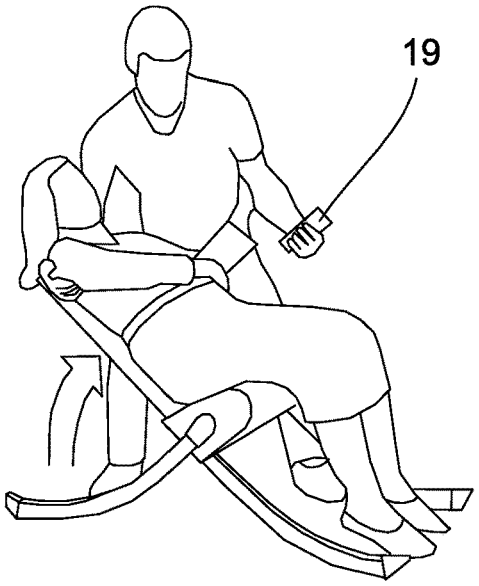

FIG. 11 shows that he supports her neck with his right hand, while he via the remove controller 19 activates a drive unit in the traversing element so that the secondary leg starts rotating via brackets 18. The angle between the tertiary direction and horizontal increases as indicated by the thick arrow.

Figure 12:
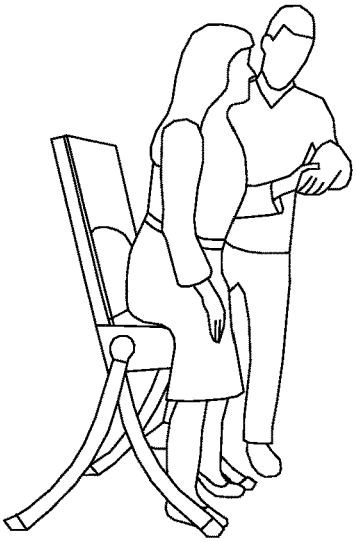

FIG. 12 shows the equipment in a second configuration, where she has been raised and able to exit the equipment, which is now configured as a chair, on her own or with assistance from him.

To sum up, there is presented an equipment (13) for raising of an associated lying person, comprising a seat (1), a primary leg (4), a secondary leg (5) being secondary leg (5) being rotatably connected to the seat (1) and a backrest (2), wherein the equipment is arranged to be passed from a first configuration to a second configuration by rotation of the secondary leg (5) around a rotation axis, and wherein the equipment is arranged so that it enables placement of the equipment between the associated lying person and a supporting surface while the bottom of the associated lying person is in contact with the supporting surface upon which the associated lying person is lying and subsequently raising the associated lying person by passing the equipment from the first configuration to the secondary configuration by rotation of the secondary leg (5). In a particular embodiment, the equipment is arranged for being reversibly assembled and disassembled without using tools.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. Equipment for raising of a lying person relative to a supporting surface upon which the lying person is lying, the equipment comprising:

a seat, a primary leg, wherein the primary leg is connected to the seat and having a portion extending in a primary direction away from the seat, a secondary leg, wherein the secondary leg is rotatably connected to the seat and having a portion extending in a secondary direction away from the seat, a backrest, wherein the backrest is connected to the seat and having a portion extending away from the seat in a tertiary direction, wherein the backrest defines an absence of material between the backrest and the seat, wherein the secondary leg is configured for rotation around a rotation axis, wherein the equipment is configured to be passed from a first configuration to a second configuration by rotation of the secondary leg around the rotation axis, wherein an angle between the primary direction and the secondary direction decreases during said rotation, and wherein the absence of material is configured to permit:

placement of the equipment in the first configuration at least partially between the lying person and the supporting surface upon which the person is lying, without displacement of the buttocks of the lying person in a vertical direction, while the buttocks of the lying person are in contact with the supporting surface upon which the lying person is lying and subsequently raising the lying person by passing the equipment from the first configuration to the secondary configuration by rotation of the secondary leg.

2. The equipment according to claim 1, wherein the equipment is configured such that, while the buttocks of the lying person are in contact with the supporting surface:

the backrest may be positioned below a back of the lying person, and the seat may be positioned below legs of the lying person.

3. The equipment according to claim 1, wherein the equipment is configured such that the absence of material between the seat and the backrest, which permits the buttocks of the lying person to be in contact with the supporting surface when:

the backrest is positioned below a back of the lying person, and the seat is positioned below legs of the lying person.

4. The equipment according to claim 1, wherein an angle between the secondary direction and the tertiary direction increases during said rotation.

5. The equipment according to claim 1, wherein a largest distance between:

a point on the primary leg, and a distal point on the secondary leg, where the distal point is the point on the secondary leg, which is furthest away from the rotation axis, at least in the first position is larger than the distance $d_2$ between:

the distal point on the secondary leg.

6. The equipment according to claim 1, wherein the secondary leg is coupled to the seat via a pivot joint at one end of the secondary leg and, wherein the rotation axis is coincident with the pivot joint.

7. The equipment according to claim 5, wherein the rotation axis is at one end of the secondary leg and, wherein a distance $d_2'$ between the rotation axis, and a furthest point on the primary leg on the opposite side of the rotation axis than the distal point on the secondary leg is smaller compared to $d_2$.

8. The equipment according to claim 1, wherein one or more parts of the equipment have at least one of (i) a joint, (ii) dimensions to allow a transition fit, and (iii) a mechanical locking member configured for both disconnection and re-connection to another part of the equipment.

9. The equipment according to claim 8, wherein said disconnection and re-connection may be carried out by an assisting person without using tools.

10. The equipment according to claim 8, wherein said disconnection and re-connection is facilitated by said joint comprising:

i) a male part on a first part of the equipment, and ii) a female part on a second part of the equipment.

11. The equipment according to claim 8, wherein different parts of the equipment are kept together by a transition fit.

12. The equipment according to claim 8, wherein different parts of the equipment are kept together by said mechanical locking member selected from: a pin, a click-lock, a detent ball, or a hand-operable screw.

13. The equipment according to claim 1, wherein said equipment is configured to be disassembled into separate parts and, wherein each separate part weighs less than 12 kg.

14. The equipment according to claim 1, further comprising a motorized drive unit configured to power rotation of the secondary leg.

15. The equipment according to claim 14, further comprising an energy storage unit operably connected to the motorized drive unit.

16. The equipment according to claim 8, wherein a structural strength of said one or more parts of the equipment is configured to permit the raising of lying persons with a body mass of at least 75 kg.

17. The equipment according to claim 1, further comprising a remote controller, configured to permit an assisting person to control the equipment without being in physical contact with the equipment.

18. The equipment according to claim 1, wherein the equipment is configured to permit a rotation of the secondary leg around the rotation axis such that the equipment is passed from the first configuration to the second configuration and, during such passing:

a distal portion of the primary leg engages with the supporting surface of the lying person at a primary side of the seat, a distal portion of the secondary leg engages with the supporting surface of the lying person at a secondary side of the seat, wherein the secondary side of the seat is opposite of the first side of the seat, and, wherein during the passing from the first configuration to the second configuration the decreasing angle between the primary direction and the secondary direction during said rotation, is such that:

a distance between the seat and the supporting surface increases, and an angle between the tertiary direction and a vertical direction decreases.

19. The equipment according to claim 1, wherein in the first configuration of the equipment, an angle between the primary direction and the tertiary direction is more than 90 degrees.

20. The equipment according to claim 1, wherein in the first configuration of the equipment, an angle between the secondary direction and the tertiary direction is less than 90 degrees.

21. The equipment according to claim 1, wherein an angle between the secondary direction and the tertiary direction is substantially constant.

22. The equipment according to claim 1, which further comprises a traversing element connected to each one of the seat, the primary leg, the secondary leg, and the backrest.

23. The equipment according to claim 22, wherein:

the seat is optionally fixedly mounted on the traversing element or being part of the traversing element, the primary leg is connected to the traversing element, wherein:

an axis of a male and female connection is substantially orthogonal with the rotation axis, and wherein the male and female connection optionally comprises a detent ball, the backrest is connected to the traversing element, wherein:

an axis of the male and female connection is substantially orthogonal and, wherein the male and female connection optionally comprises a detent ball, and/or the secondary leg is connected to the traversing element.

24. The equipment according to claim 1, wherein the backrest comprises two separate parts, which are connected to the equipment at different positions separated from each other in a direction being parallel with the rotation axis.

25. A method for raising a lying person, which lying person is initially lying on an associated support surface, said method comprising:

placing a seat below legs of the lying person while the buttocks of the lying person are in contact with said associated support surface upon which the lying person is lying, placing a backrest between a back of the lying person and the associated support surface while the buttocks of the lying person are in contact with said associated support surface upon which the lying person is lying, without displacement of the buttocks of the associated lying person in a vertical direction, connecting the backrest to the seat, connecting a secondary leg to the seat, wherein the secondary leg is connected rotatably to the seat and having a portion extending in a secondary direction away from the seat, connecting a primary leg to the seat so that the primary leg is having a portion extending in a primary direction away from the seat, and raising the lying person by rotation of the secondary leg from a first angular position of the secondary leg to a second angular position of the secondary leg, wherein an angle between the primary direction and the secondary direction decreases during said rotation.

26. The method for raising a lying person according to claim 25, wherein a largest distance $d_{12}$ between:

a point on the primary leg, and a distal point on the secondary leg, wherein the distal point is the point on the secondary leg, which is furthest away from the rotation axis, at least in the first angular position is larger than the distance $d_2$ between:

the rotation axis, and the distal point on the secondary leg.

27. The method for raising a lying person according to claim 25, wherein the backrest is having a portion extending away from the seat in a tertiary direction, and an angle between the secondary direction and the tertiary direction increases during said rotation.

28. The method for raising a lying person according to claim 25, wherein the method further comprises rotating the secondary leg so that the secondary leg is passed from a first angular position to a second angular position, during which passing:

a distal portion of the primary leg engages with the associated support surface of the lying person at a primary side of the seat, a distal portion of the secondary leg engages with the associated support surface of the lying person at a secondary side of the seat, wherein the secondary side of the seat is opposite of the first side of the seat, and such that during the passing from the first angular position to the second angular position the decreasing angle between the primary direction and the secondary direction during said rotation permits:

an increase in distance between the seat and the associated support surface, and a decrease in angle between the tertiary direction and a vertical direction.

29. The method for raising a lying person according to claim 25, wherein the lying person is raised by said rotation of the secondary leg, and, wherein the buttocks of the lying person are kept in contact with the associated support surface until the lying person is raised by rotation of the secondary leg.

30. The method for raising a lying person according to claim 25, wherein one or more or all of:

connecting the backrest to the seat, connecting the secondary leg to the seat, or connecting the primary leg to the seat, takes place after:

placing the seat below the legs.

31. The method for raising a lying person according to claim 25, wherein after raising of the lying person, the method further comprises:

rotating the second leg so that said second leg assumes the first angular position.

32. The equipment according to claim 23, wherein the secondary leg is connected to the traversing element through a male and female connection where an axis of the male and female connection is substantially parallel, such as parallel, with the rotation axis.

33. The method for raising a lying person according to claim 25, wherein after raising of the lying person, the method further comprises at least one of:

disconnecting the backrest from the seat, disconnecting the secondary leg from the seat, or disconnecting the primary leg from the seat.

34. Equipment for raising of a lying person off a supporting surface upon which the lying person is lying, the equipment comprising:

a traversing element adapted to be passed under the lying person's thighs when the lying person's buttock is on the supporting surface and the lying person's knees are elevated off the supporting surface, the traversing element comprising:

a secondary joint that is rotatable about an axis of rotation relative to the traversing element, a seat, wherein said seat is fixedly mounted on the traversing element;

a primary leg that is selectively fixedly coupled to the traversing element, wherein a portion of the primary leg extends in a primary direction away from the traversing element;

a secondary leg that is selectively coupled to the secondary joint, wherein the secondary leg has a portion extending in a secondary direction away from the traversing element and wherein the secondary leg is rotatably connected to the secondary joint, a backrest that is selectively fixedly coupled to the traversing element, wherein the backrest has a portion extending away from the traversing element in a tertiary direction, wherein the backrest is adapted to be positioned between the lying person's back and the supporting surface and wherein, when coupled to the traversing element, the backrest defines said an absence of material between the backrest and the seat so that the backrest can be coupled to the traversing element while the lying person's buttock remains on the supporting surface;

wherein, when the primary leg is coupled to the traversing element, the secondary leg is coupled to the secondary joint and the backrest is coupled to the traversing element, rotating the secondary joint about the axis of rotation moves the equipment from a first configuration to a second configuration which decreases an angle between the primary direction and the secondary direction during rotation; and wherein the equipment is adapted to raise the lying person by passing the traversing element under the lying person's thighs while the lying person's buttock is on the supporting surface, coupling the primary leg to the traversing element while the lying person's buttock is on the supporting surface, coupling the second leg to the secondary joint while the lying person's buttock is on the supporting surface, coupling the backrest to the traversing element while the lying person's buttock is on the supporting surface and then raising the laying person off the supporting surface by rotating secondary joint about the axis of rotation and moving the equipment from the first configuration to the second configuration.

35. The equipment according to claim 34, wherein the traversing element further comprises a motorized drive unit adapted to power rotation of the secondary joint.

* * * * *